US011629026B2

(12) United States Patent
Agata et al.

(10) Patent No.: US 11,629,026 B2
(45) Date of Patent: Apr. 18, 2023

(54) DISCHARGING DEVICE AND IMAGE FORMING APPARATUS

(71) Applicant: CANON KABUSHIKI KAISHA, Tokyo (JP)

(72) Inventors: Jun Agata, Shizuoka (JP); Fumiki Inui, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/529,393

(22) Filed: Nov. 18, 2021

(65) Prior Publication Data

US 2022/0194728 A1 Jun. 23, 2022

(30) Foreign Application Priority Data

Dec. 23, 2020 (JP) ..... JP2020-213449

(51) Int. Cl.

| | |
|---|---|
| ***B65H 29/34*** | (2006.01) |
| ***B65H 29/22*** | (2006.01) |
| ***B65H 31/36*** | (2006.01) |
| ***B65H 29/52*** | (2006.01) |

(52) U.S. Cl.

CPC ..... *B65H 29/22* (2013.01); *B65H 29/52* (2013.01); *B65H 31/36* (2013.01); *B65H 2404/722* (2013.01)

(58) Field of Classification Search

CPC ..... B65H 2404/741; B65H 2404/7412; B65H 2404/743

See application file for complete search history.

(56) References Cited

U.S. PATENT DOCUMENTS

| | | | | |
|---|---|---|---|---|
| 5,964,459 | A * | 10/1999 | Yamanaka | B42C 1/12 270/58.08 |
| 6,290,220 | B1 * | 9/2001 | Takehara | B65H 33/08 270/58.08 |
| 6,517,065 | B2 * | 2/2003 | Miyake | G03G 15/6541 414/789.9 |
| 6,702,279 | B2 * | 3/2004 | Adachi | B65H 31/3027 271/220 |
| 7,318,584 | B2 * | 1/2008 | Kato | B42C 1/125 270/58.11 |
| 7,475,874 | B2 * | 1/2009 | Sato | B65H 31/26 271/233 |
| 8,695,971 | B2 | 4/2014 | Sekiyama et al. | |

(Continued)

FOREIGN PATENT DOCUMENTS

| | | |
|---|---|---|
| JP | H10-279166 A | 10/1998 |
| JP | 2011-046534 A | 3/2011 |

(Continued)

*Primary Examiner* — Leslie A Nicholson, III

(74) *Attorney, Agent, or Firm* — Venable LLP

(57) ABSTRACT

A discharging device includes an aligning unit for aligning stacked sheets as a sheet bundle, a discharging unit for discharging the sheet bundle, a discharged tray on which the sheet discharged by the discharging unit is stacked, and a support unit. The support unit supports the sheet bundle from below by extending in a sheet discharging direction of the sheet bundle while the sheet bundle is discharged to the discharged tray and to be accommodated in a direction opposite to the sheet discharging direction at timing when the discharging unit finishes discharging the sheet bundle.

9 Claims, 11 Drawing Sheets

(56) References Cited

U.S. PATENT DOCUMENTS

| | | | | |
|---|---|---|---|---|
| 8,905,394 | B2 * | 12/2014 | Miyake | B65H 37/04 270/58.11 |
| 9,010,754 | B2 * | 4/2015 | Matsumoto | B65H 31/34 271/223 |
| 9,919,890 | B2 * | 3/2018 | Nakano | B65H 29/14 |
| 10,099,886 | B2 * | 10/2018 | Yamamoto | G03G 15/6529 |
| 10,259,673 | B2 * | 4/2019 | Nakano | B65H 43/00 |
| 10,773,918 | B2 | 9/2020 | Hatakeyama et al. | |
| 10,822,192 | B2 * | 11/2020 | Kotani | B65H 43/08 |
| 11,215,946 | B2 | 1/2022 | Koyama et al. | |
| 11,370,631 | B2 * | 6/2022 | Noso | B65H 31/38 |
| 2002/0163119 | A1 * | 11/2002 | Kawata | B65H 31/00 271/207 |

FOREIGN PATENT DOCUMENTS

| | | | |
|---|---|---|---|
| JP | 4694401 | B2 | 6/2011 |
| JP | 2016-175739 | A | 10/2016 |
| JP | 2017-043476 | A | 3/2017 |
| JP | 2019-006561 | A | 1/2019 |

* cited by examiner

DISCHARGING DEVICE AND IMAGE FORMING APPARATUS

FIELD OF THE INVENTION AND RELATED ART

The present invention relates to a discharging device which discharges sheets of recording medium onto a discharge tray, and an image forming apparatus equipped with a discharging device.

There have been known a discharging device which catches sheets of recording medium, holds the sheets in layers, aligns the layered sheets, sorts the sheets, subjects the sheets to such post-image formation process as stapling, folding, binding, and the like, and then discharges the sheets in bundle onto sheet accumulation trays which are extended outward from the discharging device.

There are disclosed in Japanese Patent No. 4694401 and Japanese Laid-open Patent Application No. 2017-43476, sheet processing apparatuses which discharge a sheet of recording medium with the use of a pair of rollers which oppose each other, and into each of which driving force is inputted to satisfactorily convey the sheet.

However, each of the discharging devices disclosed in Japanese Patent No. 4694401 and Japanese Laid-open Patent Application No. 2017-43476 uses a sheet accumulation tray and/or the top surface of the topmost of the layered sheets of recording medium on the sheet accumulation tray to accumulate sheets of recording medium, align the sheets, and discharge the sheets. Therefore, it cannot prevent the problem that, as a sheet of recording medium is discharged from a discharging device, it rubs the top surface of the topmost of the layered sheets on the sheet accumulation tray. In particular, they suffer from such a problem that when a sheet of recording medium is discharged from an image forming apparatus which is in the two-sided mode, the bottom surface of the sheet, which is being discharged, rubs the top surface of the topmost of the layered sheets in the sheet accumulation tray, and therefore, the images are damaged. Further, the discharging devices disclosed by Japanese Patent No. 4694401 and Japanese Laid-open Patent Application No. 2017-43476 have to be controlled in the position, in terms of the vertical direction, of the top surface of the topmost of the layered sheets of recording medium in the sheet accumulation tray. Therefore, the sheet accumulation tray is required to be quickly movable upward or downward. Therefore, they require a large driving motor to deal with this requirement.

In comparison, Japanese Laid-open Patent Application No. 2011-46534 discloses a sheet processing apparatus, in which a jogger, which is in the form of a comb, is positioned on the downstream side of the pair of discharge rollers to align the sheets and keep the layered sheets in the sheet accumulation tray, separated from a sheet which is being discharged, while supporting the sheets.

However, the sheet processing apparatus disclosed in Japanese Laid-open Patent Application No. 2011-46534 is structured so that the jogger protrudes on the top side of the layered sheets on a sheet accumulation tray, which is outside the discharging device. Therefore, it is problematic in terms of usability. For example, it is difficult to remove the sheets from a sheet accumulation tray.

SUMMARY OF THE INVENTION

The objects of the present invention are to provide a discharging device which allows sheets of recording medium on its discharge tray to be easily taken out of the tray, and to provide an image forming apparatus equipped with such a discharging device.

According to an aspect of the present invention, there is provide an aligning unit, on which the sheet fed is stacked, configured to align the stacked sheets as a sheet bundle; a discharging unit configured to discharge the sheet bundle of the sheets aligned by said aligning unit; a discharged tray on which the sheet discharged by said discharging unit is stacked; and a support unit configured to support the sheet bundle from below by extending in a sheet discharging direction of the sheet bundle while the sheet bundle is discharged to said discharged tray by said discharging unit and to be accommodated in a direction opposite to the sheet discharging direction at timing when said discharging unit finishes discharging the sheet bundle.

Further features of the present invention will become apparent from the following description of exemplary embodiments (with reference to the attached drawings).

Figure 2:
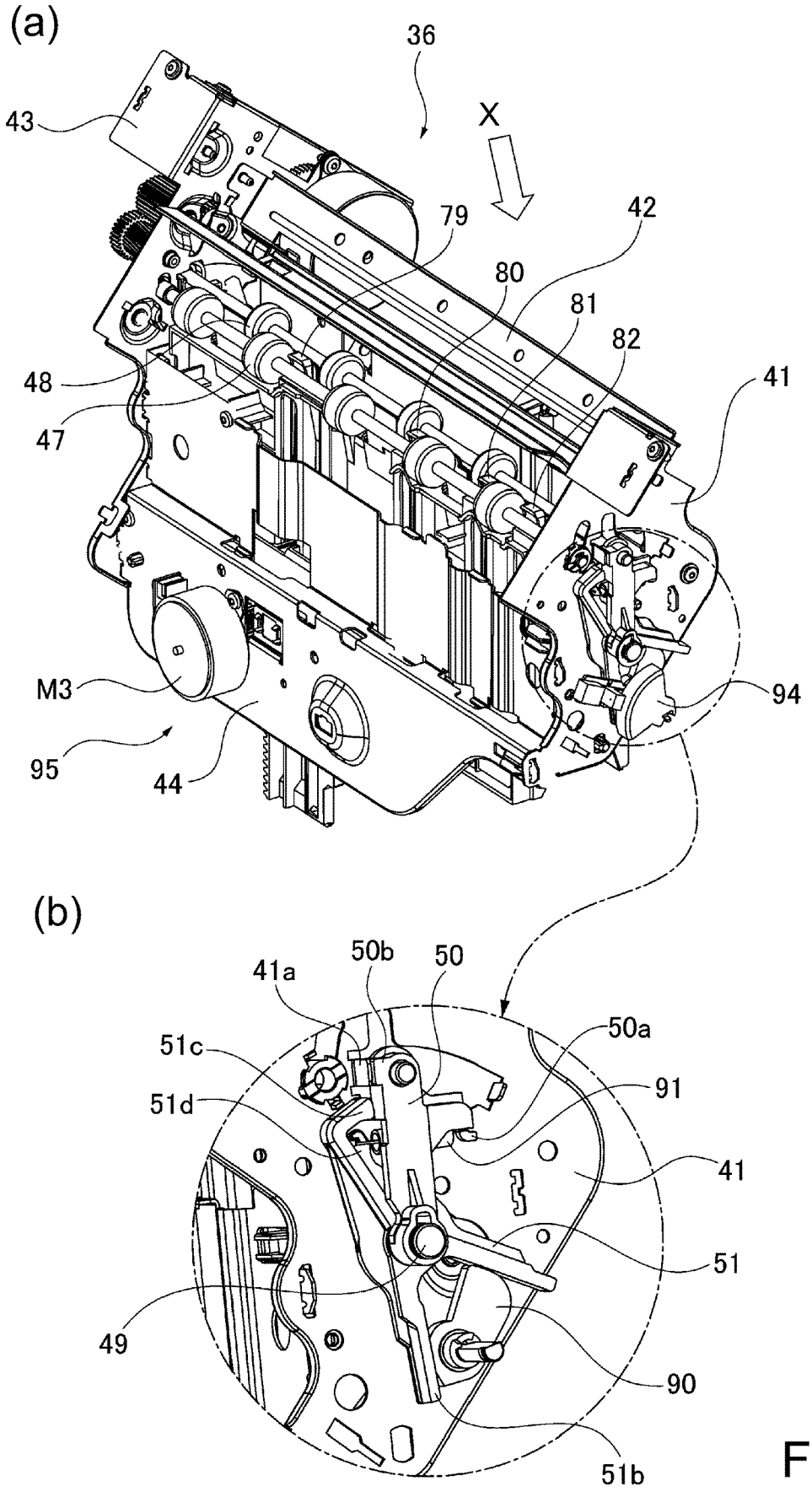

Part (a) and Part (b) of FIG. 2 are a top perspective view of the sheet bundle discharging unit of the discharging device in the first embodiment of the present invention, and an enlarged bottom view of a part of the same discharging unit.

Figure 3:
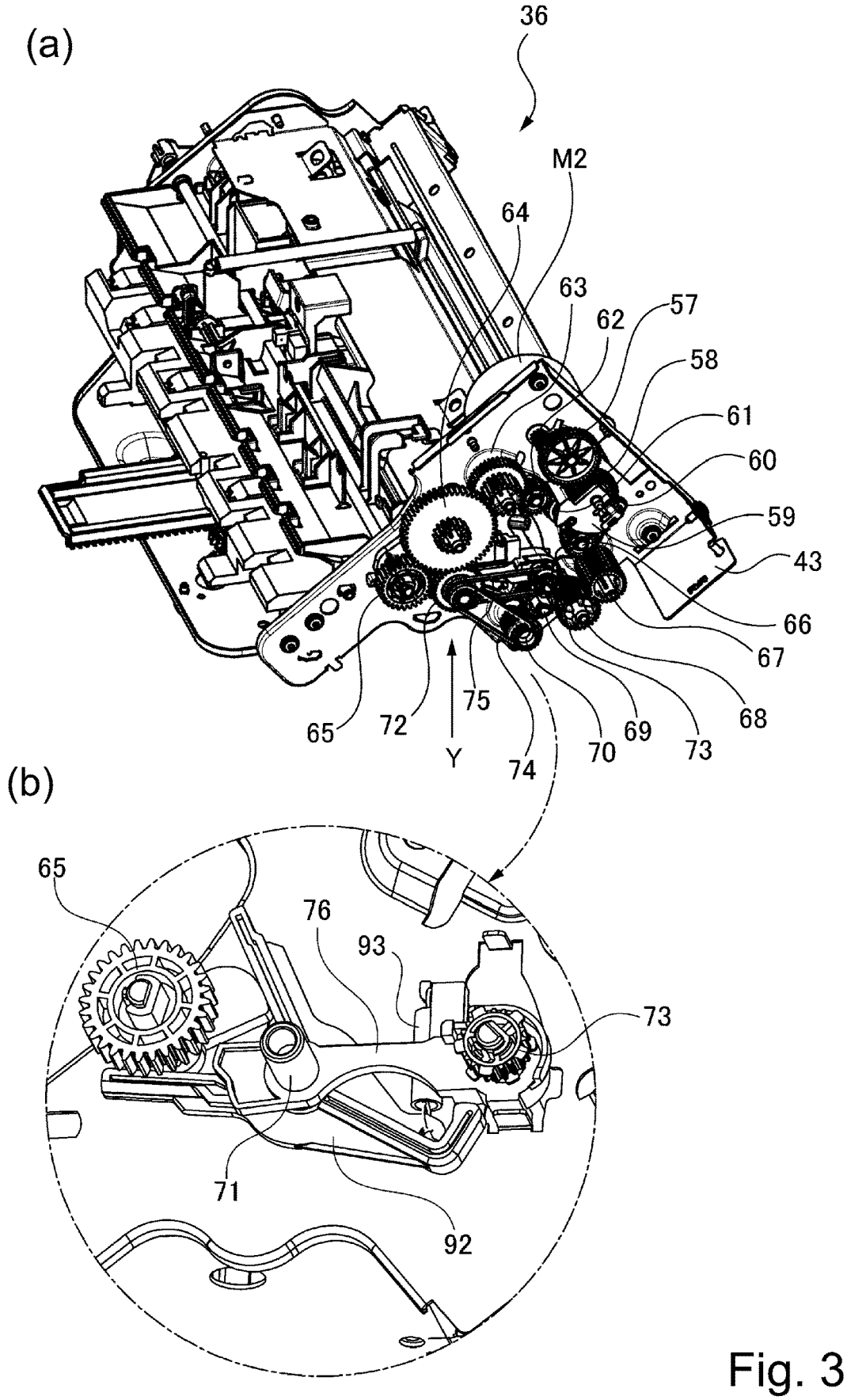

Part (a) and Part (b) of FIG. 3 are a top perspective view of the sheet bundle discharging unit of the discharging device in the first embodiment of the present invention, and an enlarged view of a part of the same discharging unit.

Figure 4:
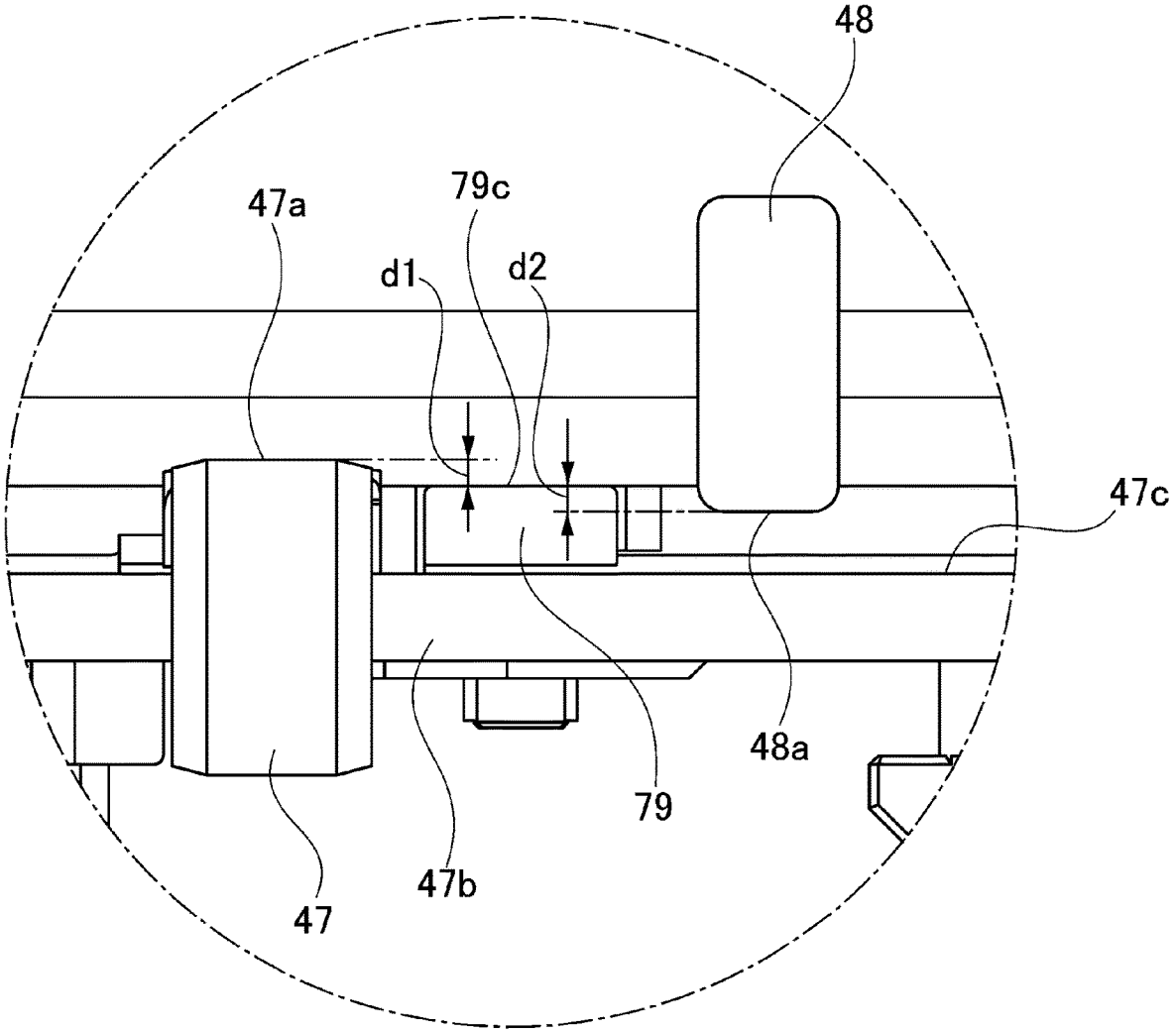

FIG. 4 is an enlarged view of a part of the sheet bundle discharging unit of the discharging device in the first embodiment of the present invention, as seen in the direction indicated by an arrow mark in FIG. 2.

Figure 5:
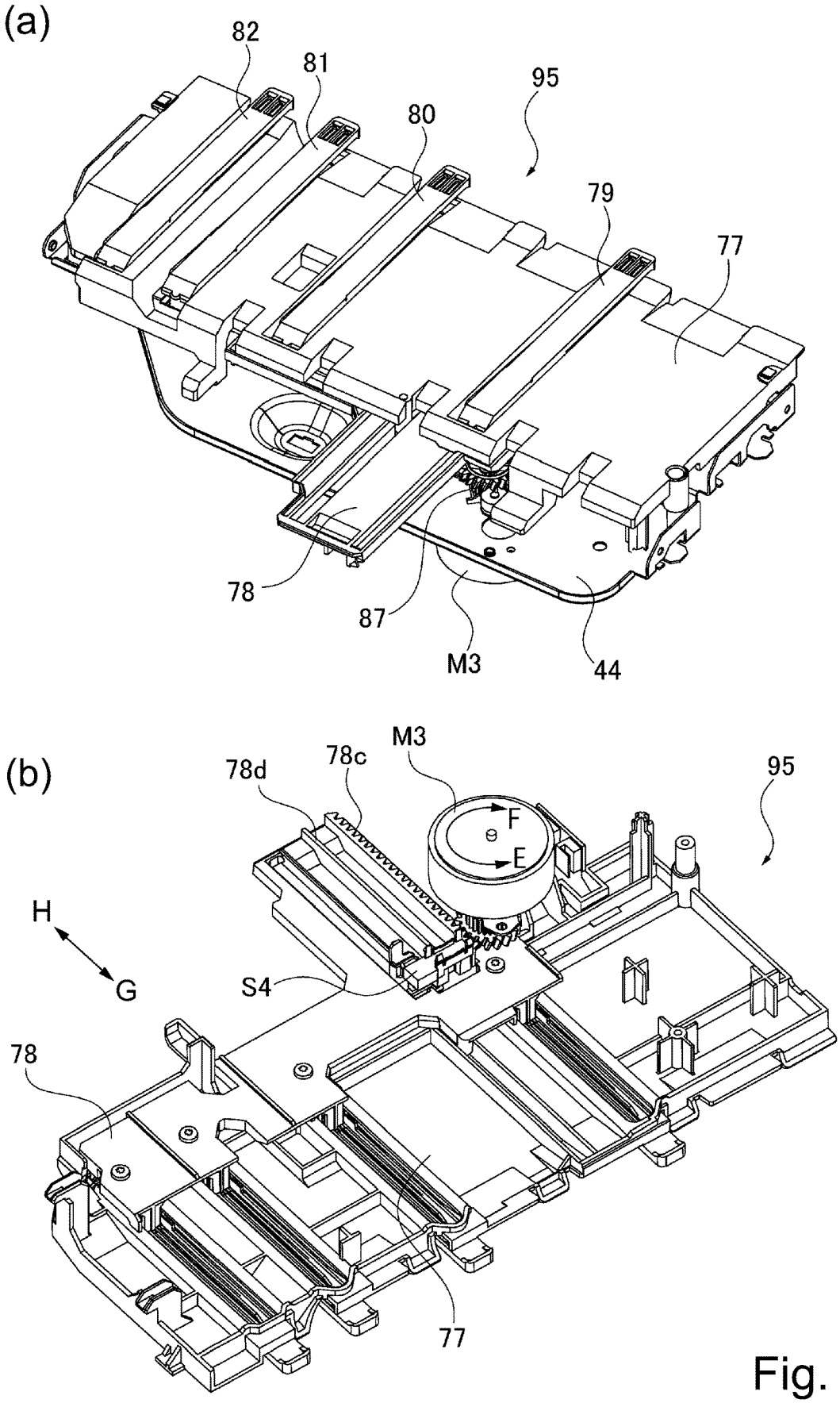

FIG. 5, part (a) and part (b), is a perspective view of the bottom unit of the discharging device in the first embodiment of the present invention.

Figure 6:
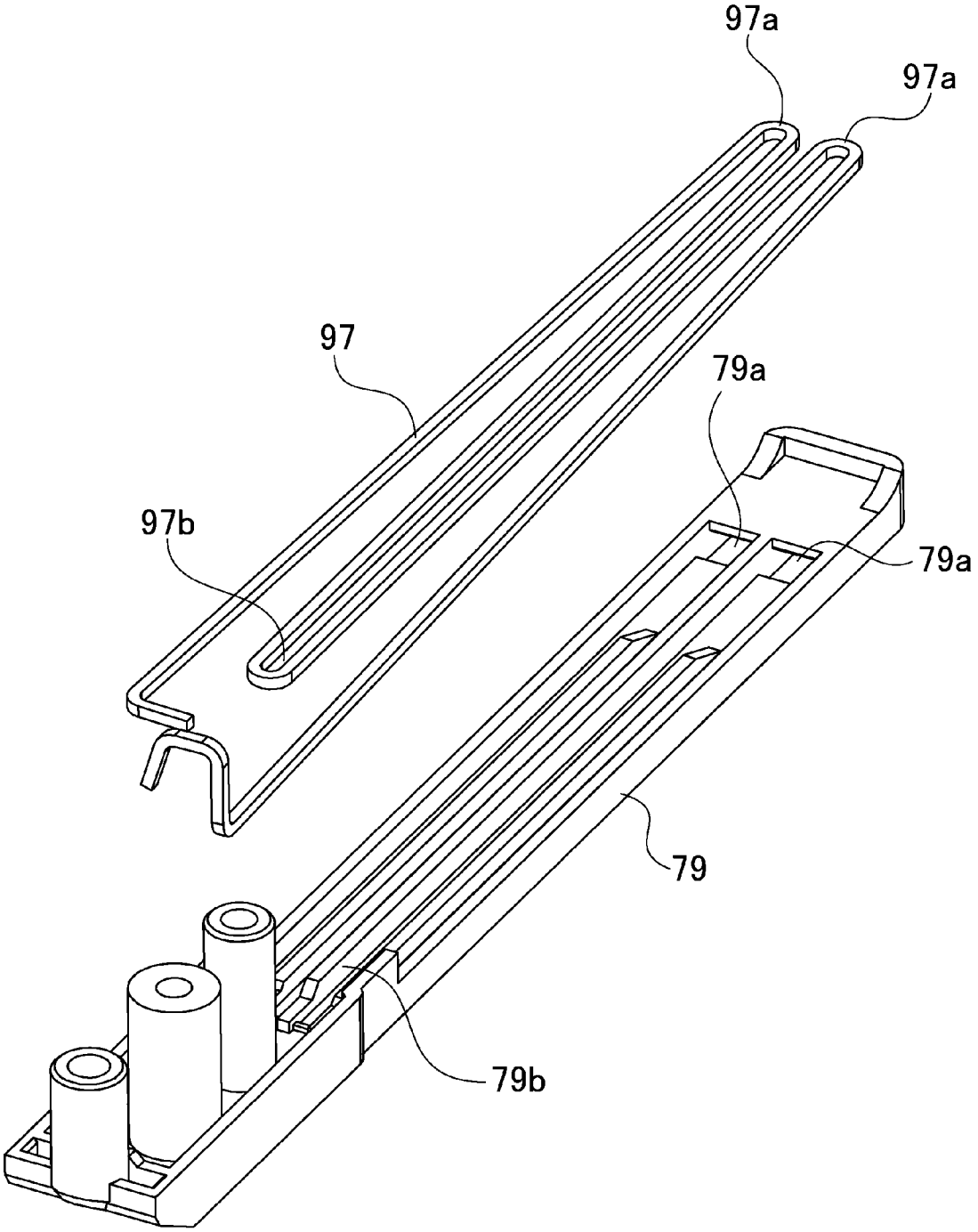

FIG. 6 is a perspective view of the support plate of the bottom unit of the discharging device in the first embodiment of the present invention.

Figure 7:
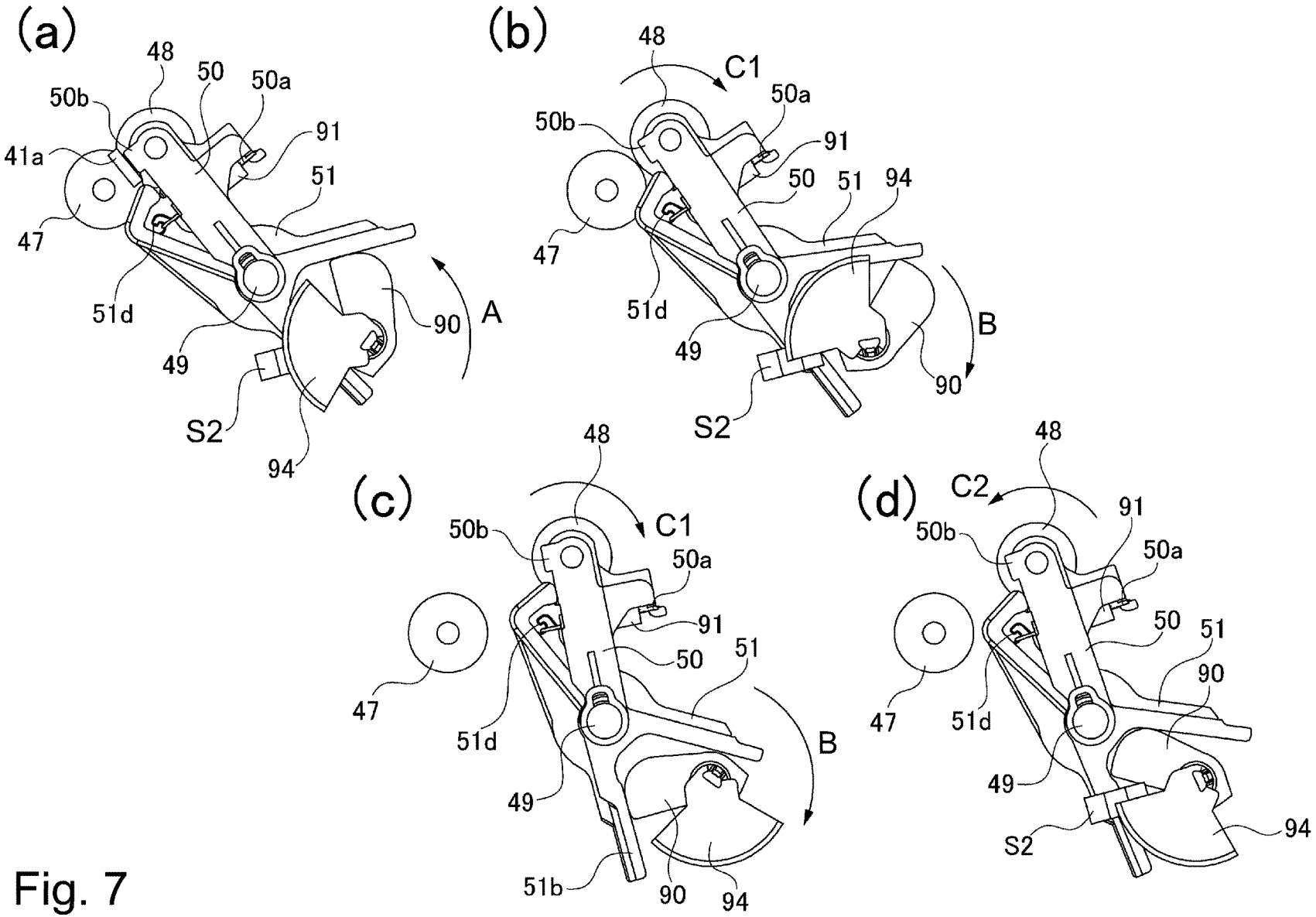

FIG. 7, part (a), part (b), part (c) and part (d), is a schematic drawing for showing the operation of the discharging device in the first embodiment of the present invention.

Figure 8:
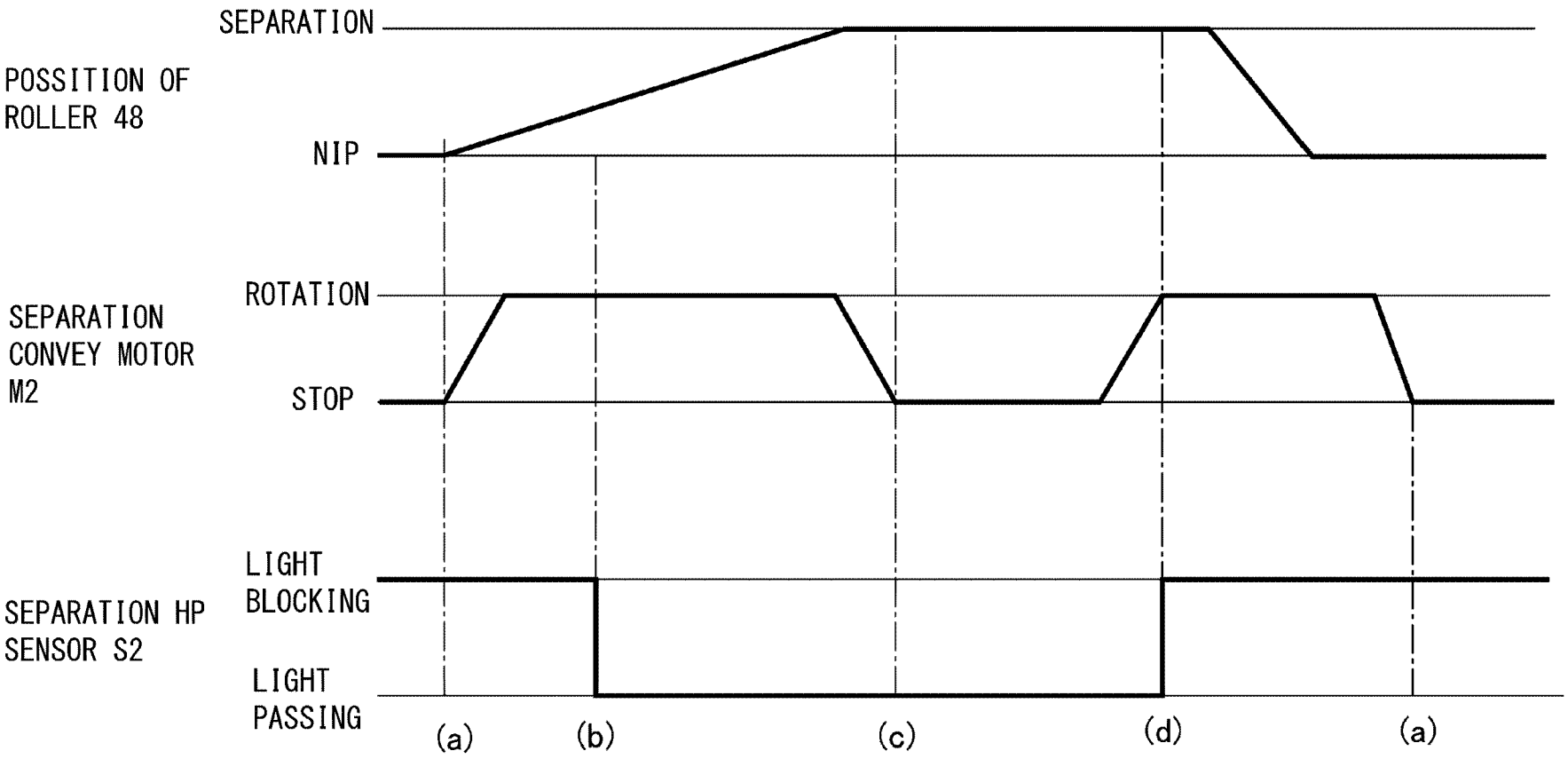

FIG. 8 is a timing chart for the discharging device in the first embodiment of the present invention.

Figure 9:
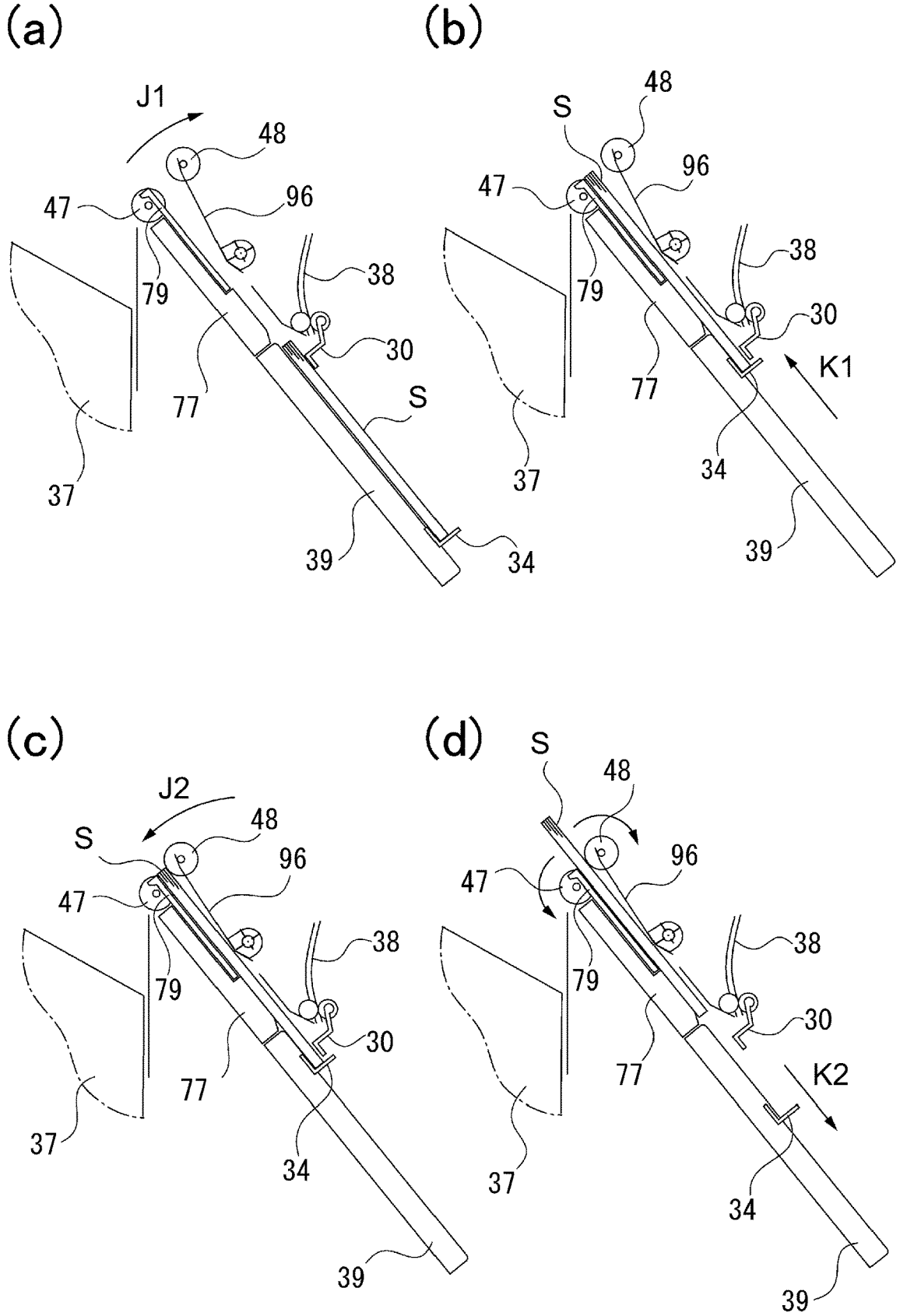

FIG. 9, part (a), part (b), part (c) and part (d), is a schematic drawing for showing the operation of the front half of the discharging device in the first embodiment of the present invention.

Figure 10:
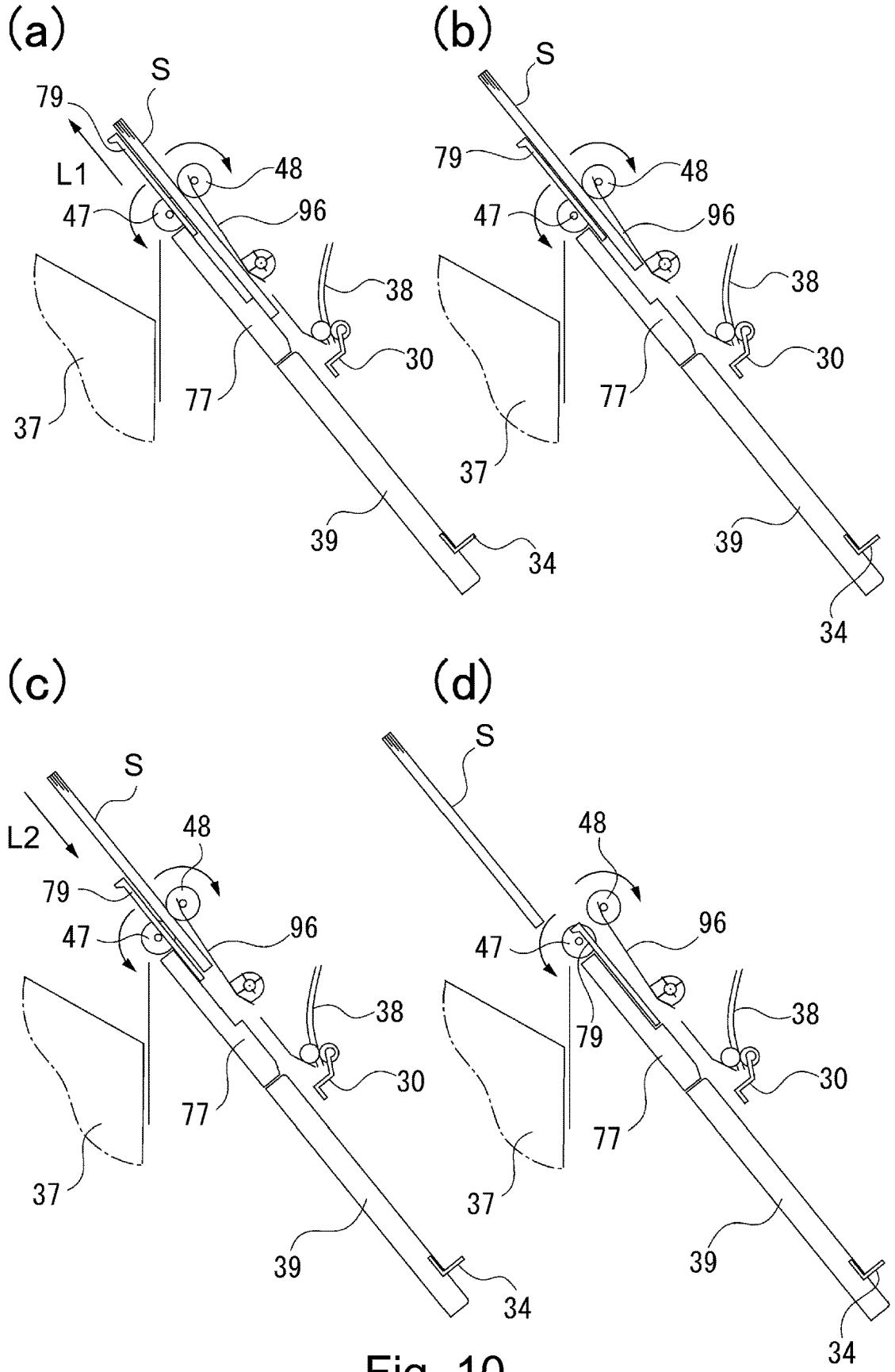

FIG. 10, part (a), part (b), part (c) and part (d), is a schematic drawing for showing the operation of the rear half of the discharging device in the first embodiment of the present invention.

Figure 11:
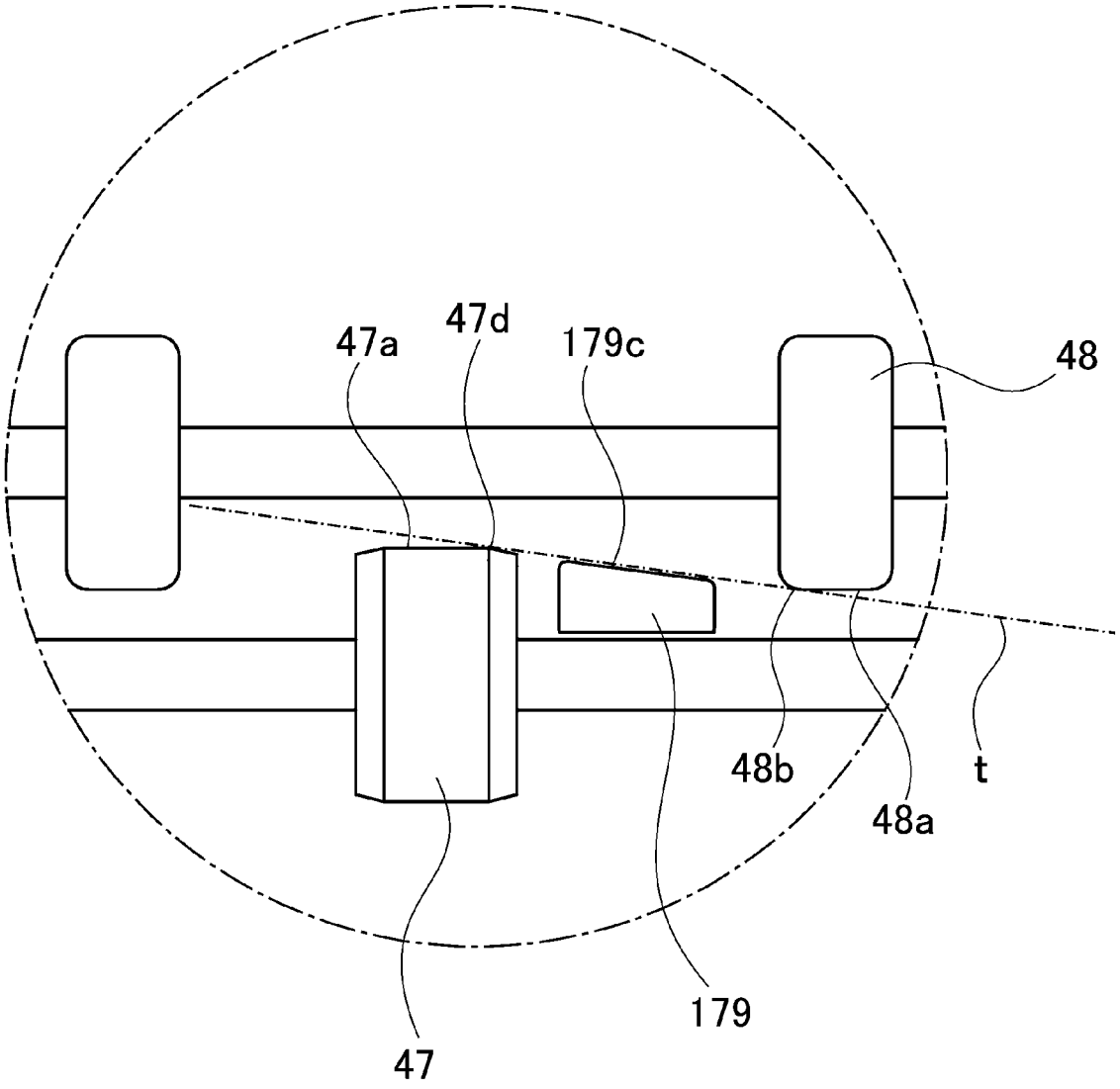

FIG. 11 is an enlarged view of a part of the discharging device in the second embodiment of the present invention.

DESCRIPTION OF THE EMBODIMENTS

Hereinafter, a few of preferred embodiments of the present invention will be described in detail, about its structure, with reference to appended drawings.

Embodiment 1

<Structure of Image Forming Apparatus>

Figure 1:
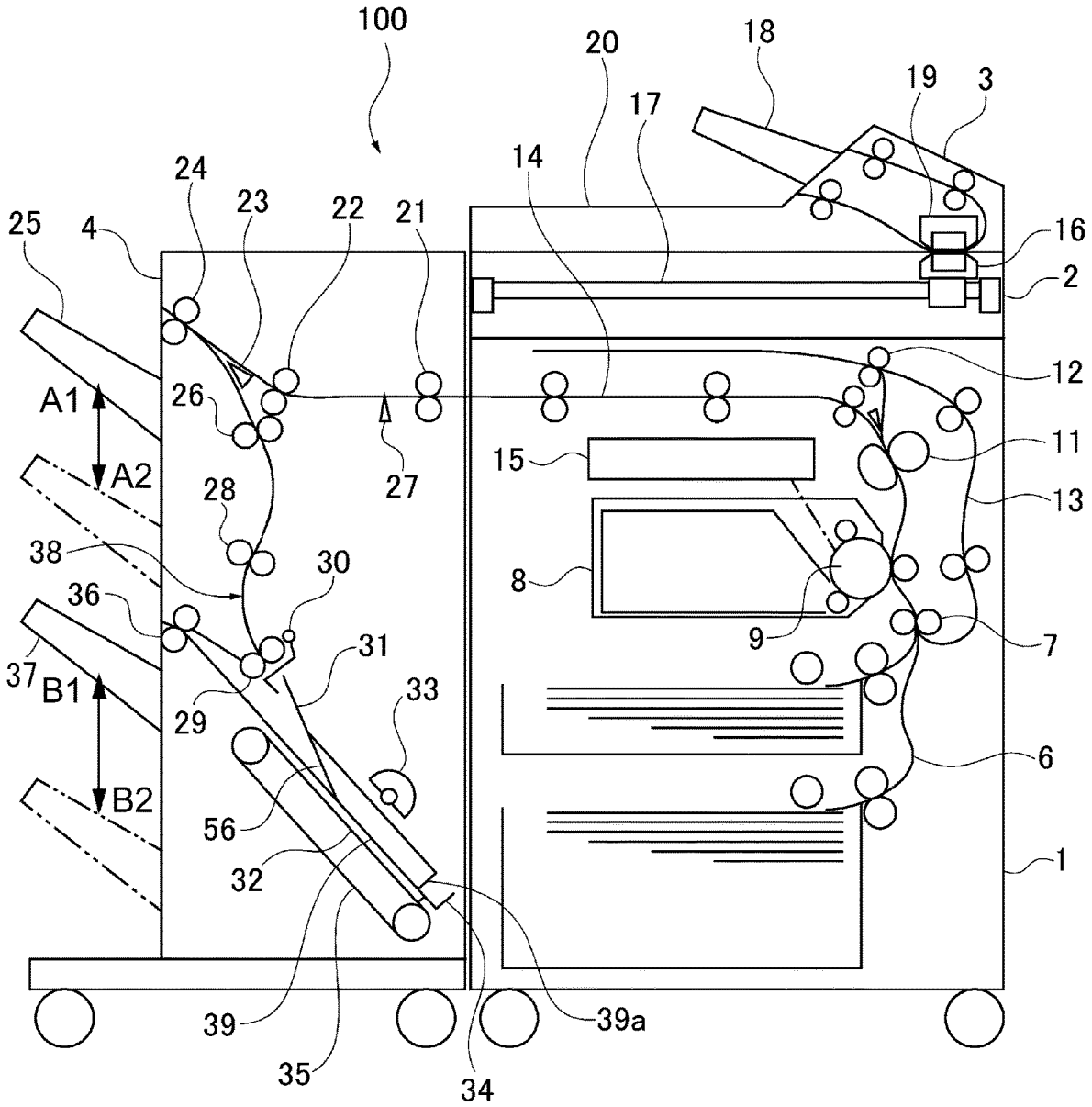
FIG. 1 is a schematic drawing of the image forming apparatus in the first embodiment of the present invention.

First, referring to FIG. 1, the image forming apparatus 100 in the first embodiment of the present invention is described in detail about its structure.

The image forming apparatus 100 has: an image formation unit 1, an image reading unit 2, an original feeding unit 3, and a discharging device 4.

The image formation unit 1 which is an image forming section, reads an original with the use of its image reading unit, develops and adjusts the data of the read image with the use of an unshown controller, and forms an image of the read image on a sheet of recording medium. The image formation unit 1 conveys the sheet, on which an image has just been formed, to the discharging device 4. By the way, the details of the structure of the image formation unit 1 will be described later.

The image reading unit 2 has: an image reading section 16 which reads the surface of an original which is facing it; a driving apparatus 17 which makes an image reading section 16 move back and forth; and the image reading section 16 which reads the surface of the original, which is facing it. The image reading unit 2 outputs the information of the image read by the image reading section 16 and/or an image reading section 19, to the unshown controller of image formation unit 1.

The image reading unit 2 can simultaneously read both surfaces of an original at the same time with the use of the image reading sections 16 and 19. Therefore, both surfaces of the original can be read by a single passage of the original through the image reading unit 2. The image reading unit 2 is structured so that image reading section 16 can reciprocally scan an original by causing the image reading section 16 to reciprocally move, with the use of driving apparatus 17, being enabled to read such an original as a booklet that cannot be handled by the original feeding unit 3.

The original feeding unit 3 has: an original placement tray 18, in which originals are to be placed; and an original catching section 20, into which originals are discharged. The original feeding unit 3 conveys the originals in the original placement tray 18, to the image reading sections 16 and 19 of the image reading unit 2. As an original is conveyed by the image reading unit 2, it is discharged into the original catching section 20 of the original feeding unit 3.

As a preset number of sheets of the recording medium are conveyed to the discharging device 4 from image formation unit 1, discharging device 4 processes (post-processing) them, and discharge them out of it. By the way, the structure of the discharging device 4 will be described later in detail.

<Structure of Image Formation Unit>

Next, the image formation unit 1 of the image forming apparatus 100 in the first embodiment of the present invention is described in detail with reference to FIG. 1.

The image formation unit 1 has a sheet feeding section 6, a pair of registration rollers 7, an image formation cartridge 8, a photosensitive drum 9, a transfer roller 10, and a fixation unit 11. Further, the image formation unit 1 has a pair of reversal rollers 12, a re-feeding section 13, a horizontal conveying section 14, and a laser scanner unit 15.

The image formation unit 1 is provided with multiple sheet feeding sections 6. Each sheet feeding section 6 is capable of holding multiple sheets of recording medium. It is capable of feeding the sheets therein one by one to the pair of registration roller 7, with a preset interval.

The pair of registration roller 7 straighten sheets of recording medium as the sheets are conveyed thereto from the sheet feeding section 6 or the re-feeding section 13, if the sheets arrive slanted. Then, they convey the sheets to the image formation cartridge 8.

The image formation cartridge 8 forms an image on a sheet of recording medium, which is delivered thereto from the sheet feeding section 6 or the re-feeding section 13. Then, it conveys the sheet, which is bearing the formed image, to the fixation unit 11. The image formation cartridge 8 has the photosensitive drum 9 and the transfer roller 10.

The photosensitive drum 9 is rotatably supported in the image formation cartridge 8. On the photosensitive drum 9, a toner image is formed through each of exposing, charging, latent image forming, and developing processes. As a sheet of recording medium is delivered to photosensitive drum 9 by the pair of registration rollers 7, the photosensitive drum 9 conveys the sheet to the fixation unit 11 while keeping the sheet pinched between itself and the transfer roller 10.

The transfer roller 10 is provided with a preset amount of electrical charge. It transfers the toner image on the photosensitive drum 9, onto a sheet of recording medium as the sheet is delivered thereto by the pair of registration roller 7.

As a sheet of recording medium, which is bearing a toner image, is conveyed to the fixation unit 11, the fixation unit 11 fixes the toner on the sheet to the sheet, by heating the toner while pressing the toner. After fixing the toner to the sheet, the fixation unit 11 conveys the sheet to the horizontal conveying section 14.

In a case where an image is to be printed on both surfaces of a sheet of recording medium, as the trailing end of the sheet arrives at the interface (nip) of the pair of reversal rollers 12, the pair of reverse rollers 12 are changed in rotational direction to change the sheet in the conveyance direction (switch-back conveyance) so that the sheet is conveyed to the re-feeding section 13.

The re-feeding section 13 conveys a sheet of recording medium to the pair of registration roller 7 as the sheet is conveyed thereto by the pair of reverse rollers 12.

As a sheet of recording medium is conveyed to the horizontal conveying section 14 by the fixation unit 11, the horizontal conveying section 14 conveys the sheet to a pair of entrance rollers 21 of the discharging device 4 by being driven by an unshown driving section. The horizontal conveying section 14 is provided with unshown internal one-way clutch which allows the conveyance rollers of the horizontal conveying section 14 to slip as a sheet of recording medium is pulled in the same direction as the direction in which the sheet is conveyed (which hereafter will be referred to simply as "conveyance direction".

Laser scanner unit 15 forms a latent image on the photosensitive drum 9 by causing a beam of laser light to move in a manner to scan the peripheral surface of the photosensitive drum 9 in the direction perpendicular to the sheet conveyance direction, with the use of its polygon mirror and lenses.

<Structure of Discharging Device>

Next, the discharging device 4 of image reading apparatus 100 in the first embodiment of the present invention is described in detail about it structure with reference to FIG. 1.

The discharging device 4 operates under the control from an unshown controlling section. The discharging device 4 has a pair of entrance rollers 21, a pair of pre-buffer rollers 22, a pair of reverse rollers 24, sheet catching top tray 25, a pair of inside discharge rollers 26, an entrance sensor 27, a pair of middle conveyance rollers 28, and a pair of kick-out rollers 29. Further, it has a sheet-bundle-pressing flag 30, a half-moon roller 33, a sheet bundle discharge guide 34, a guide driving section 35, a sheet bundle discharge unit 36, a bottom discharge tray 37, a pre-layering sensor 38, a sheet layering mid section 39, and a sheet pressing guide 56.

As a sheet of recording medium is delivered to the pair of entrance rollers 21 by the horizontal conveying section 14, the pair of entrance rollers convey the sheet to the pair of pre-buffer rollers 22.

The pair of pre-buffer rollers 22 convey the sheet of recording medium delivered thereto by the pair of entrance rollers 21, to the pair of reverse rollers 24, at a preset timing, while accelerating the sheet.

In a case where a sheet of recording medium is to be discharged into a top discharge tray 25, as the sheet is conveyed to the pre-buffer tray 22, the reverse rollers 24 discharge the sheet into the top discharge tray 25. In a case where a sheet of recording medium is to be discharged into the bottom discharge tray 37, the reverse rollers 24 temporarily withhold the sheet with such timing that the trailing end of the sheet, in terms of the sheet conveyance direction, moves past a reverse flow prevention valve, which is remaining pressed in the clockwise direction of FIG. 1 by an unshown spring. Then, the reverse rollers 24 backwardly convey the temporarily withheld sheet to the inside discharge rollers 26. Then, the reverse rollers 24 separate themselves from each other to accommodate the following sheet of recording medium, with such timing that the leading end of the sheet, in terms of the sheet conveyance direction, reaches the inside discharge rollers 26.

The reverse rollers 24 function as a buffer by layering the following sheet, that is, a sheet of recording medium which is being conveyed by the pre-buffer rollers 22, upon the preceding sheet, that is, the sheet which is being conveyed backward by the inside discharge rollers 26. The sheet buffer makes it possible to buffer a present number of sheets, regardless of sheet length, by repeatedly causing the inside discharge rollers 26 to conveying a sheet of recording backward (switch-back operation). By the way, the operation of the sheet buffer will be described later in detail.

As sheets of recording medium are successively discharged into the top discharge tray 25, the sheets are layered in the top discharge tray 25. As the sheets are layered in the top discharge tray 25, the top discharge tray 25 moves the sheets in the direction indicated by an arrow mark A in FIG. 1, according to the position of the top surface of the top sheet in the top discharge tray 25, detected by an unshown sheet surface position detection sensor, and also, according to the amount of the layered sheets in the top discharge tray 25. Further, as it is detected that the layered sheets in the top discharge tray 25 have been removed, the top discharge tray 25 moves in the direction indicated by an arrow mark A1. In other words, the top discharge tray 25 keeps the top surface of the top sheet in the top discharge tray 25 at a preset level, regardless of the amount of sheets therein.

The driving of inside discharge rollers 26 is temporarily stopped while inside discharge rollers 26 are holding a sheet of recording medium delivered thereto by the reverse rollers 24. Then, it is started to convey the sheet back to the reverse rollers 24 with the same timing as the passage of the following sheet. Then, as the sheet arrives at inside discharge rollers 26, inside discharge rollers 26 convey the sheet to middle conveyance rollers 28.

As entrance sensor 27 detect a sheet of recording medium, it outputs the result of detection to an unshown control section.

As a sheet of recording medium is conveyed to middle conveyance rollers 28 by inside discharge rollers 26, middle conveyance rollers 28 conveys the sheet to a pair of kick-out rollers 29.

As a sheet of recording medium is conveyed to the kick-out rollers 29 by middle conveyance roller 28, the kick-out rollers 29 conveys the sheet to the sheet layering mid section 39.

Sheet bundle pressing flag 30 is rotatably positioned on the downstream side of the kick-out rollers 29 in terms of the conveyance direction. It prevents the trailing end, in terms of the sheet conveyance direction, of each of the layered sheets of recording medium in the sheet layering mid section 39 from bending upward, to prevent the tailing end from interfering with the leading end, in terms of the sheet conveyance direction, of the following sheet is conveyed to the sheet layering mid section 39.

A half-moon roll 33 is rotatably supported by sheet layering mid section 31, on the downstream side, in terms of the conveyance direction, of pressing guide 56. It conveys a sheet of recording medium toward leading end, in terms of the conveyance direction, of vertical alignment referential plate 39*a* of the sheet layering mid section 39, with preset timing, after the trailing end, in terms of the sheet conveyance direction, of a sheet of recording medium passes by pre-laying sensor 38. It presses a sheet of recording medium into vertical alignment referential plate 39*a* after the sheet moves past the kick-out rollers 29. It is adjusted in conveyance pressure so that it slips on the sheet after it places the sheet in contact with vertical alignment referential plate 39*a*.

As guide driving section 35 is driven, sheet bundle guide 34 moves toward a sheet bundle discharging unit 36 in parallel with the sheet layering mid section 39, from its standby position, to push the bundle of layered sheets in the sheet layering mid section 39.

As the leading end of the bundle of sheets, in terms of the sheet bundle pressing direction, reaches the sheet bundle discharging unit 36, the driving of guide driving section 35 is stopped to stop the sheet bundle discharge guide 34. Then, guide driving section 35 is driven again to make the sheet bundle discharge guide 34 return to its standby position.

Guide driving section 35 is in connection to the sheet bundle discharge guide 34. It operates under the control from the aforementioned control section.

The sheet bundle discharging unit 36 discharges each bundle of sheets of recording medium into (or onto) the bottom discharge tray 37 as the bundle of sheets is pushed out by the sheet bundle discharge guide 34. By the way, the structure of the sheet bundle discharging unit 36 will be described later in detail.

The bottom discharge tray 37 catches each bundle of sheets of recording medium in such a manner that as each bundle is discharged by the sheet bundle discharging unit 36, the bundle is laid upon the immediately preceding bundle in the bottom discharge tray 37. It moves in the direction indicated by an arrow mark B2 in FIG. 1 in response to the amount of layered sheets therein, based on the position of the top surface of the topmost of the layered sheets detected by an unshown sheet surface sensor. Further, as it is detected that the layered sheets have been removed, the bottom discharge tray 37 moves in the direction B1 in FIG. 1. Thus, the bottom discharge tray 37 keeps the top surface of the topmost of the layered sheets therein at a preset level regardless of the amount of the layered sheets therein.

As a mid layering pre-sensor 38 detects a sheet of recording medium, it outputs the result of detection to the unshown control section.

The sheet layering mid section 39, which is an aligning section, is provided with vertical alignment referential plate 39*a*, which is at the leading end the sheet layering mid section 39 in terms of the conveyance direction. As a sheet of recording medium is conveyed to the sheet layering mid section 39, not only does the sheet layering mid section 39 catch the sheet in such a manner that the sheet will be layered upon the immediately preceding sheet, but also, align the sheets therein by causing the leading end of the sheet, in terms of the sheet conveyance direction, to bump into vertical alignment referential plate 39*a*. The sheet layering mid section 39 is provided with top guide 31, to which pressing guide 56 is solidly attached, and bottom guide 32.

The pressing guide 56 is flexible. It is kept in contact with the topmost of the layered sheets of recording medium in the sheet layering mid section 39, with the application of a preset amount of pressure.

The unshown control section controls the discharging device 4 in operation, based on the results of detection inputted from entrance sensor 27, pre-sensor 38, etc.

<Structure of Sheet Bundle Discharge Unit>

Next, referring to FIGS. 2-3, the sheet bundle discharging unit 36 of the discharging device 4 in the first embodiment of the present invention is described in detail about its structure.

Referring to FIG. 2, FIG. 2(*a*) is a perspective view of the entirety of the sheet bundle discharging unit 36. FIG. 2(*b*) is an enlargement of the portion of FIG. 2(*a*) surrounded by a single-dot chain line. By the way, FIG. 2(*b*) shows the state of the sheet bundle discharging unit 36, in which the sheet bundle discharging unit 36 is after the removal of a separation sensor flag 94.

Referring to FIG. 3, FIG. 3(*a*) is a perspective view of the entirety of the sheet bundle discharging unit 36, and FIG. 3(*b*) is an enlargement of a part of the sheet bundle discharging unit 36, as seen from direction Y in FIG. 3(*a*). By the way, FIG. 3(*b*) shows the state of the sheet bundle discharging unit 36, in which the sheet bundle discharging unit 36 is after the removal of a separation gear 64, a conveyance gear 69, a conveyance gear pulley 70, a conveyance pulley 72, a timing belt 74, and a timing belt 75.

The sheet bundle discharging unit 36 has a front sub-frame 41, a top sub-frame 42, a rear sub-frame 43, a bottom sub-frame 44, a bottom discharge roller 47, a top discharge roller 48, a pivot shaft 49, a roller supporting front arm 50, and a pressing front arm 51.

The sheet bundle discharging unit 36 has the top discharge roller 48, which is the first discharge roller and has multiple first disks, and the bottom discharge roller 47, which is the second discharge roller and has multiple disks. The sheet bundle discharging unit 36 is a discharge unit which discharge a sheet of recording medium in the sheet discharge direction, with the use of the two sets of rollers. It is structured so that the abovementioned disks (rotational members) of the top discharge roller 48 and those of the bottom discharge roller 47 are alternately positioned in terms of the direction which is perpendicular to the sheet discharge direction, and also, that as the disks of the top discharge roller 48 and those of the bottom discharge roller 47 are seen from the sheet width direction, the disks of the top discharge roller 48 partially overlap with the disks of the bottom discharge roller 47.

Further, the sheet bundle discharging unit 36 has a step gear 57, a pendulum sun gear 58, a pendulum holder 59, a separation conveyance motor M2, a torsion spring 60, a pendulum planetary gear 61, a separation gear 62, a separation gear 63, and a separation gear 64, and a separation gear 65.

Further, the sheet bundle discharging unit 36 has a conveyance gear 66, a conveyance gear 67, a conveyance gear 68, a conveyance gear 69, a conveyance pulley 70, a pivot shaft 71, the conveyance pulley 72, and a conveyance pulley 73. Moreover, the sheet bundle discharging unit 36 has a timing belt 74, a timing belt 75, a roller support rear arm 76, a support plate 79, a support plate 80, a support plate 81, a support plate 82, and a pressure application rear arm 92.

The front sub-frame 41, the top sub-frame 42, the rear sub-frame 43, and the bottom sub-frame 44 are attached to adjacent sub-frames with small screws. To the rear sub-frame 43, the separation conveyance motor M2 is solidly attached. The bottom sub-frame 44 makes up a part of bottom unit 95, which will be described later.

The rotational shaft of the bottom discharge roller 47 is solidly attached to the conveyance gear 69.

The top discharge roller 48 transmits rotational driving force to the bottom discharge roller 47.

The bottom discharge roller 47 and the top discharge roller 48 are positioned so that, in terms of the direction which is parallel to their rotational axes, they disks are alternately positioned.

The pivot shaft 49 is crimped to the front sub-frame 41, being thereby supported by the front sub-frame 41. It supports a roller support front arm 50 and a pressure application front arm 51 so that the two arms are allowed to pivotally move relative to the front sub-frame 41.

The roller support front arm 50 is rotatably supported by the pivot shaft 49. The sheet bundle discharge unit 36 is structured so that as portion 50*a* of the roller support front arm 50 comes into contact with a stopper 41*a*, with which the front sub-frame 41 is provided, it is prevented from pivoting further in the counterclockwise direction of FIG. 2(*b*). The roller support front arm 50 is provided with a spring anchor 50*a*, with which one end of a tension spring 91 is engaged.

The pressure application front arm 51 is rotationally supported by the pivot shaft 49. It pivotally moves as it is pressed by a pressure application cam 90 which is driven by the separation conveyance motor M2. It is provided with a spring anchor 51*d*, to which other end of the tension spring 91 is engaged.

Not only is the step gear 57 in connection to the rotational shaft of the separation conveyance motor M2, but also, the pendulum sun gear 58.

The pendulum sun gear 58 is in connection to the step gear 57, and also, the pendulum planetary gear 61.

The pendulum sun gear 58 is within the pendulum holder 59, which is fixed to the pivot of the pendulum sun gear 58 in such a manner that it is allowed to swing about the pivot of the pendulum sun gear 58.

The separation conveyance motor M2 is in connection to the step gear 57 by its rotational shaft. As it is driven under the control from the aforementioned control section, it drives the pressure application cam 90 and the separation sensor flag 94.

The torque spring 60 is a leaf spring. The sheet bundle discharging unit 36 is structured so that the torque spring 60 remains in contact with the pendulum sun gear 58 and the pendulum holder 59, and also, that as the pendulum sun gear 58 pivots, the pendulum planetary gear 61 moves in the same direction as the rotational direction of the pendulum sun gear 58, causing thereby the pendulum holder 59 to move in an oscillatory manner.

The pendulum planetary gear 61 is in contact with the pendulum sun gear 58. As the separation conveyance motor M2 rotates in the clockwise direction (as seen from pinion side), the pendulum planetary gear 61 comes into contact with the pendulum planetary gear 61. On the other hand, as separation conveyance motor M2 rotates in the counterclockwise direction, the pendulum planetary gear 61 comes into contact with the conveyance gear 66.

The pendulum planetary gear 61 is in mesh with the pendulum sun gear 58. As the separation conveyance motor M2 rotates in the clockwise direction (as seen from pinion side), the pendulum planetary gear 61 becomes meshed with the pendulum planetary gear 61, whereas as the separation conveyance motor M2 rotates in the counterclockwise direction, the pendulum planetary gear 61 becomes meshed with the conveyance gear 66.

Not only is the separation gear 63 in mesh with the separation gear 62, but also, the separation gear 64.

Not only is the separation gear 64 in mesh with the separation gear 63, but also, separation gear 65.

Not only is the separation gear 65 in mesh with the separation gear 64, but also, the conveyance pulley 72.

Not only is the conveyance gear 66 in mesh with the pendulum planetary gear 61, but also, the conveyance gear 67.

The conveyance gear 67 is in mesh with the conveyance gear 66, and also, the conveyance gear 68.

The conveyance gear 68 is in mesh with the conveyance gear 67, and also, the conveyance gear 69.

The conveyance gear 69 is in mesh with the conveyance gear 68, and also, the conveyance gear pulley 70.

The conveyance gear pulley 70 is indirectly in contact with the conveyance pulley 72 by way of the timing belt 74.

The pivot shaft 71 is crimped to the rear sub-frame 43 roughly in alignment with the pivot shaft 49.

The conveyance pulley 72 is in contact with separation gear 65, and is indirectly in contact with conveyance pulley 73 by way of timing belt 75.

The conveyance pulley 73 is fixed to the top discharge roller 48.

The timing belt 74 is in connection with the conveyance gear pulley 70 and the conveyance pulley 72.

The timing belt 75 keeps the conveyance gear pulley 70 in connection to the conveyance pulley 73.

The roller support rear arm 76 is rotatably supported by the pivot shaft 71. Its rear end is in engagement with one end of the pressure application spring 93.

The support unit has multiple support plates 79. Referring to FIG. 4, each support plate 79 is positioned between the corresponding portion of the bottom discharge roller 47 and that of the top discharge roller 48. Assuming here that the distance between top surface 47*a* of the bottom discharge roller 47 and top surface 79*c* of the support plate 79 is d1, and the distance between bottom surface 48*a* and top surface 79*c* of the support plate 79 is the document tray 2, the support plate 79 is positioned so that d1 is roughly equal to d2 (d1≈d2).

Further, the support plate 79 is positioned between the top surface 47*c* of the shaft portion 47*b* of the bottom discharge roller 47 and top surface 47*a* of the bottom discharge roller 47.

The support plate 80 is positioned between the bottom discharge roller 47 and the top discharge roller 48.

The support plate 81 is positioned between the bottom discharge roller 47 and the top discharge roller 48.

The support plate 82 is positioned between the bottom discharge roller 47 and the top discharge roller 48.

By the way, each of support plates 80, 81 and 82 is positioned like the support plate 79 so that (d1≈d2) is satisfied. Further, they are positioned between the top surface 47*c* of the shaft portion 47*b* of the bottom discharge roller 47, and the top surface 47*a* of the bottom discharge roller 47.

The pressure application rear arm 92 is rotatably supported by the pivot shaft 71. It is engaged with the other end of the pressure application spring 93.

<Structure of Bottom Unit>

Next, referring to FIGS. 2-6, the structure of the bottom unit 95 of the discharging device 4 in the first embodiment of the present invention will be described in detail.

Referring to FIG. 5, FIG. 5(*a*) is a perspective view of the bottom unit 95 as seen from its bottom side, and FIG. 5(*b*) is a perspective view of the bottom unit 95 as seen from its top side.

The bottom unit 95 has the bottom sub-frame 44, a bottom conveyance guide 77, a support plate holder 78, the support plate 79, the support plate 80, the support plate 81, the support plate 82, a step gear 87, a support plate driving motor M3, a support plate HP sensor S4, and a support wire 97.

The bottom conveyance guide 77 is connected to the sub-frame 44 with unshown small screws. It supports the support plate holder 78 in a manner to enable the support plate holder 78 to linearly move in the direction indicated by an arrow mark H or G in FIG. 5(*b*).

The support plate holder 78 is provided with rack 78*c*, and light-blocking rib 78*d* for blocking light from reaching the support plate HP sensor S4. Bottom unit is structured so that when light-blocking rib 78*d* of the support plate holder 78 is remaining retracted, support plate HP sensor S2 remains exposed, whereas light-blocking rib 78*d* is remaining extended, light is prevented from reaching support plate HP sensor S2.

The support plates 79, 80, 81 and 82 are attached to the support plate holder 78 with unshown small screws. As the support plate holder 78 moves in the direction indicated by arrow mark Gin FIG. 5(*b*), support plates 79, 80, 81 and 82 extend from the bottom conveyance guide 77, whereas the support plate holder 78 moves in the direction indicated by an arrow mark H in FIG. 5(*b*), support holders 79, 80, 81 and 82 are retracted into the bottom conveyance guide 77.

Next, referring to FIG. 6, the support plate 79 is provided with a hole 79*a*, in which a protruding portion 97*a* of the support wire 97 fit.

Not only is step gear 87 in engagement with rack 78*c* of the support plate holder 78, but also, is in connection to the support plate driving motor M3. It is driven by the support plate driving motor M3 to move rack 78*c* to move the support plate holder 78 in the direction G or H shown in FIG. 5(*b*).

The support plate driving motor M3 is rotationally driven under the control from the unshown control section, based on the result of the detection by the support plate HP sensor S4. As it rotates, it drives the step gear 87. It moves the support plate holder 78 in the direction G by rotating in the direction indicated by an arrow mark E in FIG. 5(*b*). Further, it moves the support plate holder 78 in the direction indicated by an arrow mark F in FIG. 5(*b*) by being rotated in F in FIG. 5(*b*).

The support plate HP sensor S4 is fixed to the sub-frame 44 by being snap-fitted thereto.

It is provided for controlling the support plate driving motor M3 in the amount of rotation.

The support wire 97 is a reinforcement component. It is provided with a groove 97*b* for positioning the support wire 97 relative to the support plate 79, by engaging with a rib 79*b*. It is held between the support plate holder 78 and the support plate 79 by being sandwiched by the support plate holder 78 and the support plate 79.

By the way, the support plates 80, 81 and 82 are the same in structure as the support plate 79. Therefore, their structure is not illustrated, nor described.

<Operation of Sheet-Processing Rear Unit>

Next, the operation of the discharging device 4 of image reading apparatus 100 in the first embodiment of the present invention will be described in detail.

The pre-buffer rollers 22 convey a sheet of recording medium while accelerating the sheet with preset timing, based on a point in time at which the trailing end, in terms of the sheet conveyance direction, of the sheet passes by entrance sensor 27.

In a case where the final destination of a sheet of recording medium is the top discharge tray 25, as the trailing end, in terms of the sheet conveyance direction, of the sheet reaches between the pre-buffer rollers 22 and the reverse roller 24, the pre-buffer rollers 22 decelerate the sheet to a preset speed (discharge speed), and then, discharge the sheet into the top discharge tray 25. On the other hand, in a case where the final destination of the sheet is the bottom discharge tray 37, the pre-buffer rollers 22 temporarily stop the sheet with such timing that the trailing end, in terms of the sheet conveyance direction, of the sheet passes by the backward movement prevention valve which is remaining pressed by an unshown spring in the clockwise direction of FIG. 1. Then, they convey the sheet backward (switch back), to the inside discharge rollers 26.

As the leading end, in terms of the sheet conveyance direction, of a sheet of recording medium reaches the inside discharge rollers 26, the reverse rollers 24 separate from each other, and prepare to accommodate the next sheet of recording medium, which is being conveyed toward the reverse rollers 24. Driving of the reverse rollers 24 is temporarily stopped while the sheet is remaining sandwiched by the reverse rollers 24. Then, it is restarted to convey the sheet backward, with such timing that the next sheet passes. That is, the reverse rollers 24 function as buffer by placing a sheet of recording medium on the immediately preceding sheet.

As a sheet of recording medium is conveyed by the inside discharge rollers 26, it is conveyed to the kick-out rollers 29 by way of an intermediary conveyance rollers 28. Then, it is conveyed to the sheet layering mid section 39. As the sheet arrives at the sheet layering mid section 39, its leading end, in terms of the conveyance direction bumps into the vertical alignment referential plate 39*a* of the sheet layering mid section 39, being thereby aligned with the sheets on the sheet layering mid section 39.

The half-moon roll 33 conveys a sheet of recording medium toward the sheet layering mid section 39 with preset timing, after the trailing end, in terms of sheet conveyance direction, of the sheet passes by pre-loading mid sensor 38.

An unshown crosswise alignment jogger aligns relative to an unshown crosswise alignment reference plate, after a sheet of recording medium arrives at the vertical alignment referential plate 39*a*.

After a preset number of sheets of recording medium are aligned, they are bound by an unshown stapler. Then, the sheet bundle discharge guide 34 which is in connection to the guide driving section 35 moves in parallel toward the sheet bundle discharging unit 36 from its standby position, whereby the sheet bundle is pushed out of the sheet bundle discharging unit 36.

As the leading end of the sheet bundle, in terms of the direction in which the bundle is to be pushed out, reaches the sheet bundle discharge guide 34, the sheet bundle discharge guide 34 stops. Then, it returns to its standby position.

As the sheet bundle discharging unit 36 receives a sheet bundle from the sheet bundle discharge guide 34, it discharges the bundle into the bottom discharge tray 37.

As sheets of recording medium accumulate in the top and bottom sheet discharge trays 25 and 37, the trays move in the direction A2 or B1, according to the position of the top surface of the topmost of the sheets of recording medium, which is detected by an unshown sheet surface detection sensor, as sheets are discharged into the trays one after another. Further, as it is detected by the unshown sheet surface detection sensor that the sheets in the top and bottom discharge trays 25 and 37, the trays 25 and 37 move in the direction A1 or B1. Therefore, the top surface of the top discharge tray 25 and that of the bottom discharge tray 37 remain at preset levels, respectively.

<Operation of Sheet Bundle Discharge Unit>

Next, the operation of sheet bundle discharge unit 36 of the image reading apparatus 100 in the first embodiment of the present invention is described in detail.

To begin with, referring to FIGS. 7 and 8, the operation of the sheet bundle discharging unit 36 about its mechanism for separating the top discharge roller 48 from the bottom discharge roller 47 is described in detail.

Referring to FIG. 7, FIG. 7(*a*) shows the state of the sheet bundle discharging unit 36, in which the top and bottom discharge rollers 48 and 47 are remaining pressed each other, forming a nip between them; FIG. 7(*b*), the state of the sheet bundle discharging unit 36, in which the top and bottom discharge rollers 48 and 47 have just begun to separate from each other; FIG. 7(*c*), the state of the sheet bundle discharging unit 36, in which the top and bottom discharge rollers 48 and 47 have completely separated; and FIG. 7(*d*) shows the state of the sheet bundle discharging unit 36 right after separated the top and bottom discharge rollers 48 and 47 have begun to move toward each other to form a nip.

Referring to FIG. 8, the horizontal axis represents time. The vertical axis represents the distance between the top discharge roller 48 and the bottom discharge roller 47, number of rotations of the separation conveyance motor M2, and state of separation HP sensor S2, listing from the top.

When the sheet bundle discharging unit 36 is in the state shown in FIG. 7(*a*), and a sheet of recording medium is being conveyed, the pressure application cam 90 presses the pressure application front arm 51 in the direction A of FIG. 7(*a*), by coming into contact with separation lever section 51*b*. At this point in time, the roller support front arm 50 is prevented from moving in the direction A, by the engagement between the stopper 41*a* of the front sub-frame 41 and latching section 50*b*. Therefore, the top discharge roller 48 remains pressed upon the bottom discharge roller 47, that is, in the state in which the distance between the two rollers 48 and 47 is smallest.

Further, the sheet bundle discharging unit 36 generates the pressure for conveying a sheet of recording medium to the top discharge roller 48 by the stretching tension spring 91, which is in engagement with the spring anchor 50*a* of the roller support front arm 50 and the spring anchor 51*d* of the pressure application front arm 51. Here, the disks of the top discharge rollers 48 and the disks of the bottom discharge roller 47 are alternately positioned as shown in FIG. 4. Therefore, they do not come into contact with each other.

When the sheet bundle discharging unit 36 is in the state shown in FIG. 7(*b*), in which the sensor changes in its state, the pressure application cam 90 and the separation sensor flag 94 are rotationally moved in the direction B of FIG. 7(*b*) by a preset angle (45 degrees, for example) by the driving of the separation conveyance motor M2. Thus, a separation sensor S2 changes in state from the one in which it blocks light to the one in which it allows light to pass. Then, as the driving of the separation conveyance motor M2 is stopped, the pressure application cam 90 and the separation sensor flag 94 stop after they were moved by a preset angle (224.5 angles, for example). Meanwhile, the roller support front arm 50 and the pressure application front arm 51 rotationally move in the direction C1 of FIG. 7(*b*) as the pressure application cam 90 rotates in the direction B.

When the sheet bundle discharging unit 36 is in the state shown in FIG. 7(*c*), and before it receives a sheet of recording medium, the pressure application cam 90 is rotated in the direction B by the driving of the separation conveyance motor M2, and then, the driving of the separation conveyance motor M2 is stopped. Thus, latching portion 50*b* of the roller support front arm 50 separates from the stopper 41*a*. Thus, the top discharge roller 48 is kept in such a state that its distance from the bottom discharge roller 47 is largest. At this point in time, the force from the tension spring 91 does not act on the pressure application cam 90. Further, only force to which the pressure application cam 90 is subjected is the moments generated about the pivot shaft 49 by the weights of the top discharge roller 48, the roller support front arm 50, the pressure application front arm 51, and the tension spring 91. Also at this point in time, the pressure application cam 90 is in contact with separation lever section 51*b*.

When the sheet bundle discharging unit 36 is in the state shown in FIG. 7(*d*), in which the separation sensor S2 is switched in state, as the separation conveyance motor M2 is driven, the pressure application cam 90 and the separation sensor flag 94 move in the direction B (to be added to drawings) by a preset angle (30.5 degrees, for example). Thus, the separation sensor flag 94 blocks the separation sensor S2 from light.

Then, the driving of the separation conveyance motor M2 is stopped, causing the pressure application cam 90 and the separation sensor flag 94 to stop in such a position that is away from where they were blocking light, by a preset angle (60 degrees, for example). Thus, a nip is formed between the top discharge roller 48 and the bottom discharge roller 47 as shown in FIG. 7(*a*).

As described above, the top discharge roller 48 repeatedly carries out the operations shown in FIGS. 7(*a*)-7(*d*), being thereby forming the nip or separated from the bottom discharge roller 47.

Next, referring to FIGS. 9 and 10, the sheet bundle discharging operation of the sheet bundle discharging unit 36 is described in detail.

Referring to FIG. 9, FIG. 9(*a*) shows: a state of the sheet bundle discharging unit 36, in which the top discharge roller 48 has been moved away from the bottom discharge roller 47; FIG. 9(*b*), a state of the sheet bundle discharging unit 36, in which the sheet bundle discharging unit 36 has begun to convey a sheet bundle; FIG. 9(*c*), a state of the sheet bundle discharging unit 36, in which there is a nip between the two rollers 48 and 47; and FIG. 9(*d*) shows a state of the sheet bundle discharging unit 36, in which the sheet bundle discharging unit 36 has just begun to discharge a sheet bundle.

Referring to FIG. 10, FIG. 10(*a*) shows a state of the sheet bundle discharging unit 36, in which the support plate 79 has begun to be extended; FIG. 10(*b*), a state of the sheet bundle discharging unit 36, in which the support plate 79 is in its full length; FIG. 100, a state of the sheet bundle discharging unit 36, in which the support plate 79 has just begun to be retracted; and FIG. 10(*d*) shows a state of the sheet bundle discharging unit 36, in which the sheet bundle discharging unit 36 has just discharged sheet bundle S.

By the way, it is only the operation of the support plate 79 that is shown by FIGS. 9 and 10. However, the operations of support plates 80, 81 and 82 are the same as that of the support plate 79.

As soon as sheet bundle S begins to be stacked in the sheet layering mid section 39, the top discharge roller 48 begins to move away from the bottom discharge roller 47 in the direction indicated by an arrow mark J1 in FIG. 9(*a*). As for the support plate 79 on the bottom conveyance guide 77, it remains on standby in the position into which it was retracted.

Next, the sheet layering mid section 39 carries out preset operations (post-processing) such as aligning of stacked sheet bundles, stapling, etc. Then, it begins to convey sheet bundle S in the direction indicated by an arrow mark K1 in FIG. 9(*b*), with the sheet bundle discharge guide 34.

Next, the sheet layering mid section 39 conveys sheet bundle S to where sheet bundle S can be nipped by the bottom discharge roller 47 and the top discharge roller 48, by the sheet bundle discharge guide 34. Then, it stops. The top discharge roller 48 is made to begin to nip sheet bundle S by the driving of the separation conveyance motor M2, and sandwiches sheet bundle S between itself and the bottom discharge roller 47 (9(*c*)). That is, by supporting the top discharge roller 48 in such a manner that the top discharge roller 48 can be pivotally moved toward, or away from, the bottom discharge roller 47, it is possible to discharge sheet bundle S while applying an optimum amount of pressure, that is, such pressure that is proportional to the thickness of sheet bundle S.

Next, the bottom discharge roller 47 and the top discharge roller 48 begin to rotate in the direction indicated in FIG. 9(*d*) to discharge sheet bundle S. As for the sheet layering mid section 39, as soon as the two rollers 47 and 48 begin to rotate, it begins to move in the direction indicated by an arrow mark K2 in FIG. 9(*d*) to prepare to accommodate the next sheet bundle S. Then, it stops at where it accepts the sheet bundle discharge guide 34.

Next, the support plate holder 78 is moved in the direction G in FIG. 5(*b*) by the driving of support plate driving motor M3. Thus, the support plates 79, 80 and 81 begin to move in the direction indicated by an arrow mark L1 in FIG. 10(*a*), which is the same direction as the extension direction as well as discharge direction. As for the bottom discharge roller 47 and the top discharge roller 48, they discharge sheet bundle S.

Next, the support plate holder 78 moves in the direction Gin FIG. 5(*b*), and stops. Thus, the support plates 79, 80 and 81 extend to their full length, and stop. Further, discharging of sheet bundle S is continued (FIG. 10(*b*)).

Next, as the discharging of the trailing end, in terms of the conveyance direction, of sheet bundle S nears, the driving of support plate driving motor M3 is started. Thus, the support plate holder 78 moves in the direction H shown in FIG. 5(*b*).

Therefore, as the discharging of the trailing end, in terms of the conveyance direction, of sheet bundle S nears, the support plates 79, 80, 81 and 82 begin to move in the direction indicated by an arrow mark L2 shown in FIG. 10(*c*), that is, the retraction direction.

As for the timing with which the support plates 79, 80, 81 and 82 begin to be retracted, it is controlled so that the timing with which the trailing end, in terms of the conveyance direction, of sheet bundle S, and the timing with which the retraction of the support plates 79, 80, 81 and 82 roughly coincide. Therefore, the support plates 79, 80, 81 and 82 are retracted into the bottom conveyance guide 77 with the same timing as the timing with which the discharging of sheet bundle S by the bottom discharge roller 47 and the top discharge roller 48 ends.

Next, as the trailing end, in terms of the conveyance direction, of sheet bundle S passes by the bottom discharge roller 47 and the top discharge roller 48, sheet bundle S is discharged into the bottom discharge tray 37 and layered therein (FIG. 10(*d*)).

Right after the passing of the leading ends, in terms of the direction L1, of sheet bundle S by the bottom discharge roller 47 and the top discharge roller 48, the leading ends, in terms of the direction L1, of the support plates 79, 80, 81 and 82 will be on the opposite side from the leading end, in terms of the direction L1, of sheet bundle S. Therefore, sheet bundle S can be easily discharged.

As described above, while sheet bundle S is discharged, the support plates 79, 80, 81 and 82 extend, and support sheet bundle S from the bottom side of sheet bundle S. Therefore, while sheet bundle S is discharged, it is kept separated from sheet bundles S in the bottom discharge tray 37. Therefore, it does not occur that as sheet bundle S is pushed out of the sheet bundle discharging unit 36, it and sheet bundles S in the bottom discharge tray 37 disturb each other, vice versa.

Further, this embodiment can make support plates 79, 80, 81 and 82 the same in structural component. Therefore, this embodiment can reduce the sheet bundle discharging unit 36 in cost.

The sheet bundle discharging unit 36 is provided with multiple support plates 79, 80, 81 and 82, which are aligned in the widthwise direction (left-right direction in FIG. 4), which is perpendicular to discharging direction L1, with preset intervals. Therefore, sheet bundle S is reliably held.

Further, the support plates 79, 80, 81 and 82 are positioned between the top discharge roller 48 and the bottom discharge roller 47. Therefore, they can be extended or retracted without interfering with the top discharge roller 48 and the bottom discharge roller 47.

Further, distance d1 between the top surfaces of the support plates 79, 80, 81 and 82 and the top surface of the bottom discharge roller 47 was made equal to distance d2 between the bottom surfaces of the top discharge roller 48. Therefore, it is possible to reliably support sheet bundle S.

Moreover, the support plates 79, 80, 81 and 82 are disposed between top surface 47*c* of the shaft portion 47*b* of the bottom discharge roller 47, and top surface 47*a* of the bottom discharge roller 47. Therefore, it is possible to reliably support sheet bundle S without increasing the sheet bundle discharging unit 36 in the pressure to be applied to sheet bundle S.

Further, the support plates 79, 80, 81 and 82 are provided with internal the support wire 97. Therefore, they can reliably support sheet bundle S.

In this embodiment, the sheet bundle discharging unit 36 Is provided with the support plates 79, 80, 81 and 82 which support sheet bundle S from the bottom side of sheet bundle S by extending in the sheet bundle discharging direction while sheet bundle S is discharged into the bottom discharge tray 37 by the bottom discharge roller 47 and the top discharge roller 48. Further, before and after sheet bundle S is discharged onto the bottom discharge tray 37 by the bottom discharge roller 47 and the top discharge roller 48, support plates 79, 80, 81 and 82 remain retracted. Therefore, not only is it possible to prevent sheets of recording medium from sustaining frictional damages, but also, to reduce in size the motor for driving the bottom discharge roller 47 to make it easier to take the sheets in the bottom discharge tray 37 out of the bottom discharge tray 37.

Embodiment 2

The image forming apparatus in the second embodiment of the present invention is the same as that in the first embodiment, in the structures shown in FIG. 1 to FIG. 6, except for the structure of its support plate 179. Therefore, it is not described.

Referring to FIG. 11, the sheet bundle discharging unit 36 is structured so that top surface 179*c* of the support plate 179, which comes into contact with sheet bundle S, is positioned on the bottom side of straight line t, which is tangential to the bottom discharge roller 47 and the support plate 179, and is roughly parallel to straight line t.

More concretely, the support plate 179 has top surface 179*c*, which is a slant flat surface which is parallel to straight line t between point 48*b* of bottom surface 48*a* of the top discharge roller 48 adjacent to the support plate 179, on the support plate 179 side, and point 47*d* of top surface 47*a* of the bottom discharge roller 47 adjacent to the support plate 179, on the support plate 179 side. Further, support plate 179 is positioned on the under side of the straight line t between point 48*b* of bottom surface 48*a* of the top discharge roller 48, on the support plate 179 side, and point 47*d* of top surface 47*a* of the bottom discharge roller 47, on the support plate 179 side.

Here, points 48*a* and 47*d* are on the supporting member side. By the way, the support plates in this embodiment, which are equivalent to support plates 80, 81, and 82, are similar in structure to the support plate 179.

By the way, the operation of the post-processing unit and sheet bundle discharging unit, in this embodiment, are the same as those of the post-processing unit and sheet bundle discharging unit, in this embodiment, are the same as those in the first embodiment. Therefore, they are not described here.

As described above, in this embodiment of the present invention, the discharging device 4 which is to be connected to the main assembly of an image forming apparatus for forming a color image which is sensitive to the stresses to which sheet bundle S is subjected, is provided with the support plate 179 shaped like the wavy form of sheet bundle S, which is formed by its bottom discharge roller 47 and top discharge roller 48. Therefore, it may be smaller in the pressure generated between sheet bundle S and the support plate 179. Therefore, it can discharge a sheet of recording medium while keeping the image thereon excellent.

The embodiments of the present invention described above are not intended to limit the present invention in scope. It is needless to say that these embodiments are variously modifiable within the gist of the present invention.

More concretely, in the first and second embodiments of the present invention, the bottom discharge rollers 47 and the top discharge roller 48 are positioned so that, in terms of the direction parallel to their rotational axes, the disks of the bottom discharge roller 47 and those of the top discharge roller 48 are alternately positioned. However, these embodiments are not intended to limit the present invention in scope. That is, the present invention is also compatible with a discharging device structured so that, in terms of the direction parallel to the rotational axes of bottom and top discharge roller, the disks of top discharge roller and those of bottom discharge roller are the same in position.

Not only does the present invention make it possible to prevent a sheet of recording medium from sustaining damages attributable to friction, but also, to reduce the motor for driving the discharge trays in size, making it easier to take the sheets of recording medium in the discharge tray out of the tray.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-213449 filed on Dec. 23, 2020, which is hereby incorporated by reference herein in its entirety.

What is claimed is:

1. A discharging device for discharging a sheet, comprising:

an aligning unit, on which the sheet fed is stacked, configured to align the stacked sheets as a sheet bundle;

a discharging unit configured to discharge the sheet bundle of the sheets aligned by said aligning unit, wherein said discharging unit is provided with a roller pair constituted of a first roller including a plurality of first rotatable members and a second roller including a plurality of second rotatable members and discharges the sheet in the sheet discharging direction by said roller pair, the plurality of first rotatable members and the plurality of second rotatable members are disposed in a different position with respect to the sheet widthwise direction perpendicular to the sheet discharging direction each other and so as to partially overlap as seen from the sheet widthwise direction;

a discharged tray on which the sheet discharged by said discharging unit is stacked; and a plurality of support members configured to support the sheet bundle from below by extending in a sheet discharging direction of the sheet bundle while the sheet bundle is discharged to said discharged tray by said discharging unit and to be accommodated in a direction opposite to the sheet discharging direction at timing when said discharging unit finishes discharging the sheet bundle, wherein said plurality of support members are disposed between said first roller and said second roller with respect to the sheet widthwise direction.

2. A discharging device according to claim 1, wherein said plurality of said support members are disposed with an interval along a sheet widthwise direction perpendicular to the sheet discharging direction.

3. A discharging device according to claim 1, wherein a distance between an upper surface of said support members and an upper surface of said second roller is equal to a distance between a lower surface of said first roller and the upper surface of said support members.

4. A discharging device according to claim 3, wherein said plurality of support members are disposed between an upper surface of a rotational axis portion of said first roller and the upper surface of said second roller.

5. A discharging device according to claim 1, wherein said plurality of support members are disposed below a straight line connecting an end point of the lower surface of said first roller adjacent to said support members and on said support unit side, and an end point of the upper surface of said second roller adjacent to said support members and on said support unit side.

6. A discharging device according to claim 1, wherein said first roller is pivotally supported so as to be movable up and down.

7. A discharging device according to claim 1, wherein each of said plurality of support members includes a reinforcing member.

8. A discharging device according to claim 1, wherein a leading end of said support members in the sheet discharging direction is positioned in a side of the direction opposite to the sheet discharging direction than a leading end of the bundle of sheet in the sheet discharging direction after the leading end of the sheet bundle in the sheet discharging direction passes through said discharging unit.

9. An image forming apparatus comprising:

a discharging device according to claim 1;

an image forming portion configured to form an image on a sheet and feed the sheet on which the image is formed to said discharging device.

* * * * *